US009347226B2

(12) United States Patent
Ouellet

(10) Patent No.: US 9,347,226 B2
(45) Date of Patent: May 24, 2016

(54) ALUMINUM DECK PLANK HAVING A SEALING GASKET

(71) Applicant: Vincent Houle, Sherbrooke (CA)

(72) Inventor: Andre Ouellet, Magog (CA)

(73) Assignee: Vincent Houle, Sherbrooke, QC (CA)

( * ) Notice: Subject to any disclaimer, the term of this patent is extended or adjusted under 35 U.S.C. 154(b) by 0 days.

(21) Appl. No.: 13/871,434

(22) Filed: Apr. 26, 2013

(65) Prior Publication Data

US 2014/0318066 A1 Oct. 30, 2014

Related U.S. Application Data

(60) Provisional application No. 61/639,813, filed on Apr. 27, 2012.

(51) Int. Cl.
*E04F 15/02* (2006.01)
*E04F 15/06* (2006.01)

(52) U.S. Cl.
CPC ..... *E04F 15/02016* (2013.01); *E04F 15/02172* (2013.01); *E04F 15/06* (2013.01); *E04F 2015/0205* (2013.01); *E04F 2201/0153* (2013.01)

(58) Field of Classification Search
CPC ..... E04F 15/02177; E04F 15/163; E04F 15/02435; E04F 15/02441; E04F 15/02194; E04F 15/06; E04F 15/02183; E04F 15/02038; E04F 15/02166; E04F 15/02161; E04F 15/02172; E04F 15/02405; E04F 15/02016; E04F 2201/0153; E04F 2015/0205
USPC ..... 52/588.1, 177, 836, 581, 892.1, 302.4; D25/123, 125; 404/41
See application file for complete search history.

(56) References Cited

U.S. PATENT DOCUMENTS

| | | | | |
|---|---|---|---|---|
| 3,043,407 | A * | 7/1962 | Marryatt | 52/588.1 |
| 3,555,762 | A * | 1/1971 | Costanzo, Jr. | 52/588.1 |
| 3,813,839 | A * | 6/1974 | Simpson et al. | 52/506.1 |
| 4,048,960 | A * | 9/1977 | Barnidge et al. | 119/529 |
| 4,892,052 | A | 1/1990 | Niccum | |
| 4,951,992 | A * | 8/1990 | Hockney | 296/204 |
| 5,050,361 | A | 9/1991 | Hallsten | |
| 5,050,362 | A * | 9/1991 | Tal et al. | 52/588.1 |
| 5,613,339 | A | 3/1997 | Pollock | |
| 5,816,010 | A * | 10/1998 | Conn | 52/588.1 |
| 6,226,950 | B1 * | 5/2001 | Davis | 52/592.1 |
| 6,584,748 | B2 * | 7/2003 | Bresnahan | 52/650.3 |
| 7,415,801 | B2 * | 8/2008 | Zeng et al. | 52/177 |
| 8,359,794 | B2 * | 1/2013 | Biro et al. | 52/177 |
| 2005/0210774 | A1 * | 9/2005 | Zeng et al. | 52/177 |

* cited by examiner

*Primary Examiner* — Robert Canfield
*Assistant Examiner* — Babajide Demuren
(74) *Attorney, Agent, or Firm* — Anglehart et al.

(57) ABSTRACT

A deck plank has an elongated length, two opposite sides extending along the elongated length, two ends located on opposite ends of the elongated length, and a continuous cross-section along the elongated length. The deck plank comprises an insertion member extending the length of one of the two sides and forms a groove extending the length thereof and shaped to retain a sealing gasket therein.

14 Claims, 5 Drawing Sheets

ALUMINUM DECK PLANK HAVING A SEALING GASKET

This application claims priority based on provisional 61/639,813 filed Apr. 27, 2012

FIELD OF THE INVENTION

The present invention relates generally to decks but more particularly to an aluminum deck plank having a sealing gasket.

BACKGROUND OF THE INVENTION

The invention relates to load bearing deck structures, and in particular to a deck structure of advantageous construction for interconnecting deck planks and the frame structure without any welds.

Deck structures have often been formed of aluminum, particularly aluminum extrusions assembled together. Typically aluminum slats run the full length of the structure, with transverse structural members underneath the slats at appropriate spacings.

Most prior art requires the use of complex extrusions as well as gutter means to collect water seeping in between planks. The reasoning being that if one can't stop water infiltration, might as well collect the water so that it does not fall down, which is important in multilevel dwellings for example. Using complex extrusions and insertions means to connect planks together can result in squeaking noise between planks when people walk on a deck built using those planks.

There are some prior art which disclose the use of a caulking bead being applied by a tradesman at the moment of installation but applying caulking can be messy, uneven, and ultimately quite unreliable as a means for providing a good seal.

SUMMARY OF THE INVENTION

In view of the foregoing disadvantages inherent in the known devices now present in the prior art, the present invention, which will be described subsequently in greater detail, is to provide objects and advantages which are:

To provide for a load bearing deck structures, whereby the gaps between each plank does not allow for water infiltration.

In order to do so, the deck plank has an elongated length, two opposite sides extending along the elongated length, two ends located on opposite ends of the elongated length, and a continuous cross-section along the elongated length. The deck plank comprises an insertion member extending the length of one of the two sides and forms a groove extending the length thereof and shaped to retain a sealing gasket therein.

A sealing gasket extending the length of the groove and shaped to snugly fit within and be retained by the insertion member. The second of the two sides includes a gasket compression tab extending the length of the second side and shaped and adapted to engage and compress the sealing gasket of an adjacent deck plank to thereby form a water barrier between the deck plank and the adjacent deck plank. The second of the two sides further includes an end rib, a planar surface, and a fulcrum member each extending the length thereof, wherein the fulcrum member is adapted to engage a surface of the adjacent deck plank when the insertion member of the adjacent deck plank engages the gasket compression tab of the deck plank, thereby adapted to create a compressive force between the insertion member of the adjacent deck plank when engaging the gasket compression tab of the deck plank.

In a preferred embodiment, the deck plank has the insertion member and the sealing gasket both have circular cross-section.

The deck plank has the groove of the insertion member include opposing ribs extending the length thereof and formed to more securely retain the sealing gasket therein.

The deck plank has the deck plank further include at least one reinforcement rib extending along the elongated length thereof and having a width such that when the deck plank is in use within a structure of a deck, the at least one reinforcement rib, the end rib, and the planar surface are adapted to hold the deck plank in a parallel position to the deck structure.

In yet another preferred embodiment, the deck plank has the fulcrum member formed perpendicular to the planar surface.

The deck plank is formed from a material or combination of materials chosen from a list of materials consisting of aluminum, plastic, and rubber.

The deck plank is further comprised of at least one mechanical fastener at each opposite end thereof and adapted to secure the deck plank to joists of a deck structure.

The deck plank has the gasket compression tab include a bulbous end adapted and shaped to engage the sealing gasket of an adjacent deck plank.

A deck for use along a housing structure, the deck comprising a plurality of parallel joist members, and opposite end joist members connecting respective ends of the parallel joist members forming a deck shape; and a plurality of deck planks as described hereinabove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
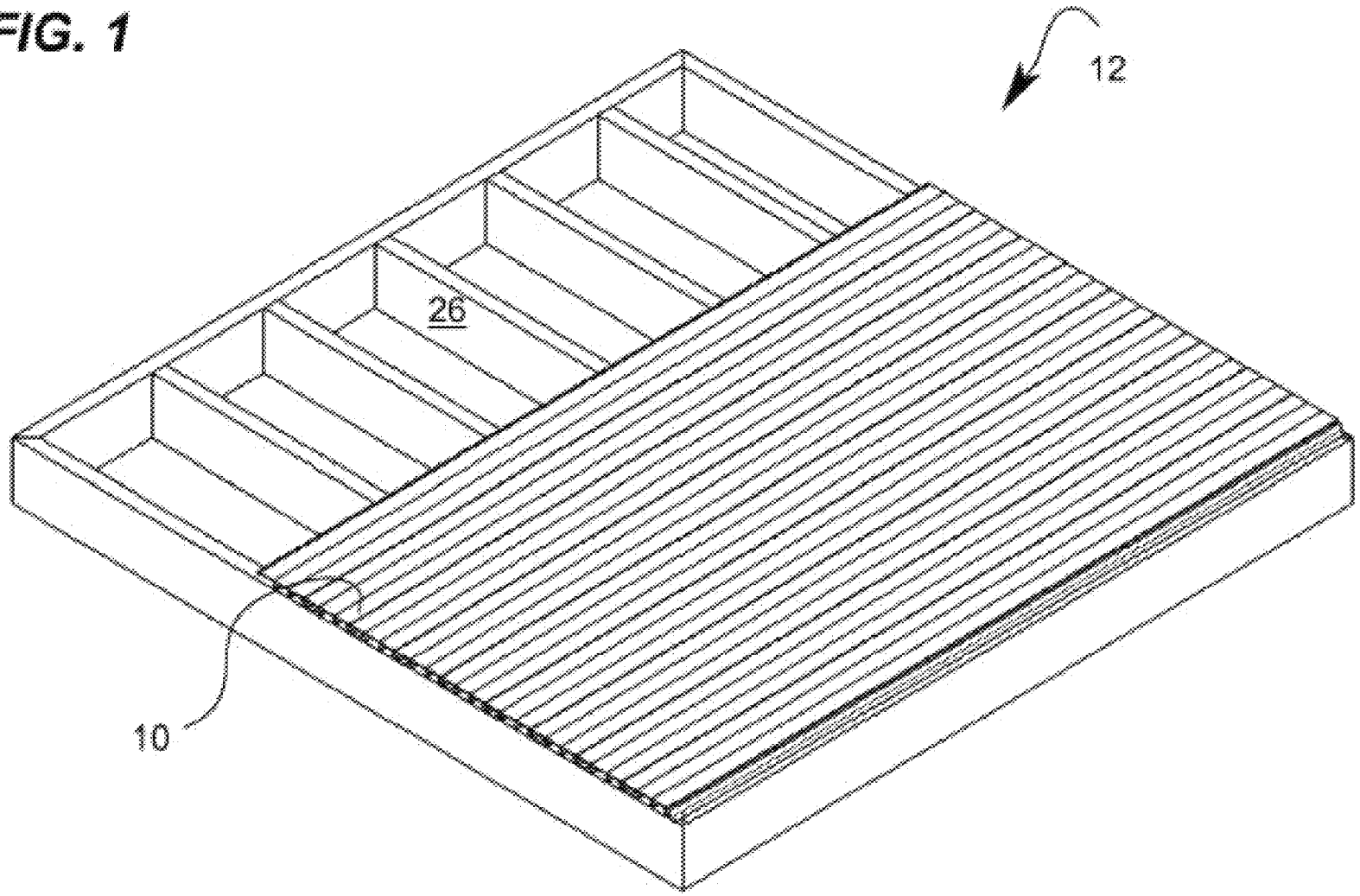
FIG. 1 Isometric view of the invention in context.
Figure 2:
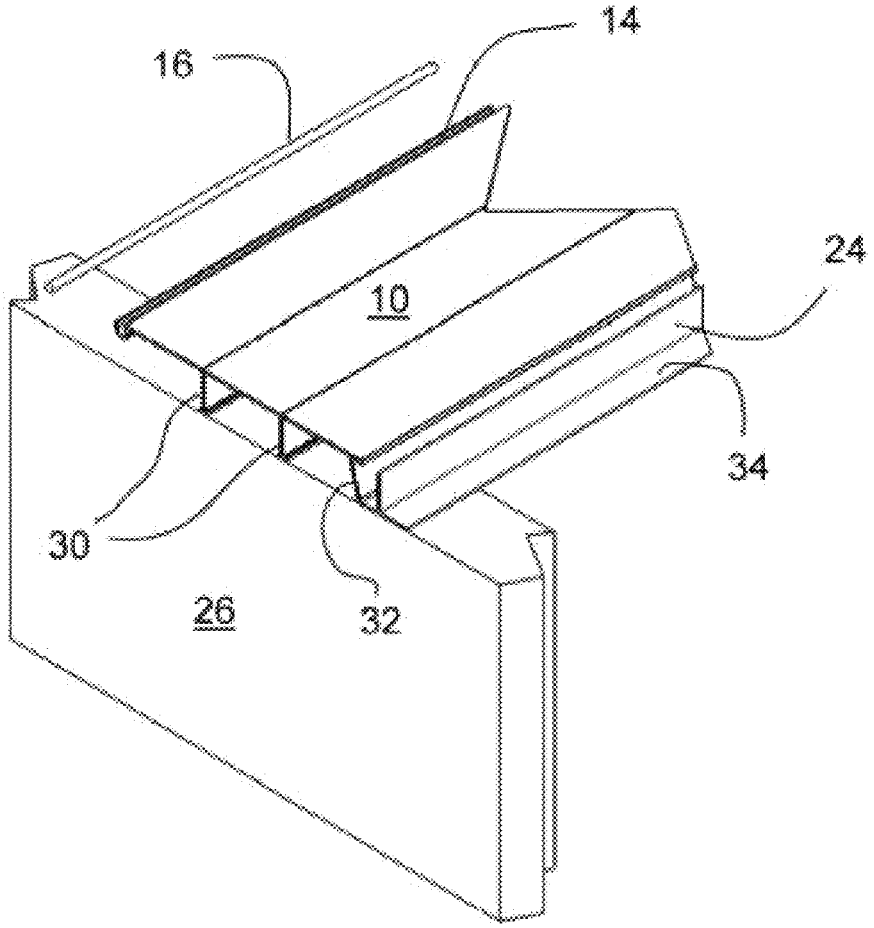
FIG. 2 Isometric view of a plank on a joist.
Figure 3:
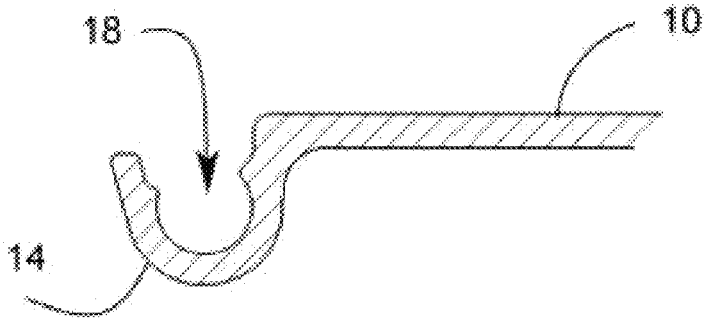
FIG. 3 Side elevation of an insertion member.
Figure 4:
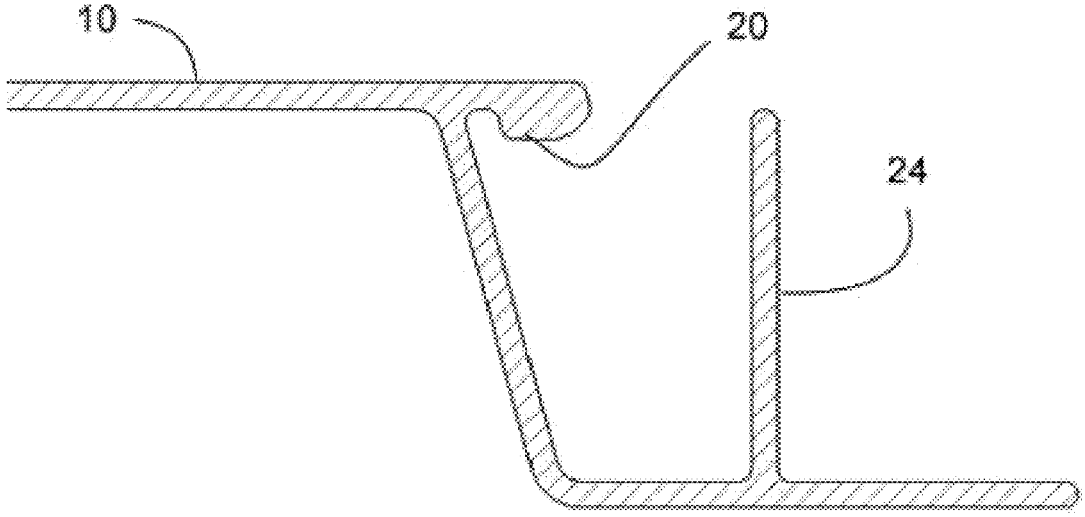
FIG. 4 side elevation of the end rib with the fulcrum member.
Figure 5:
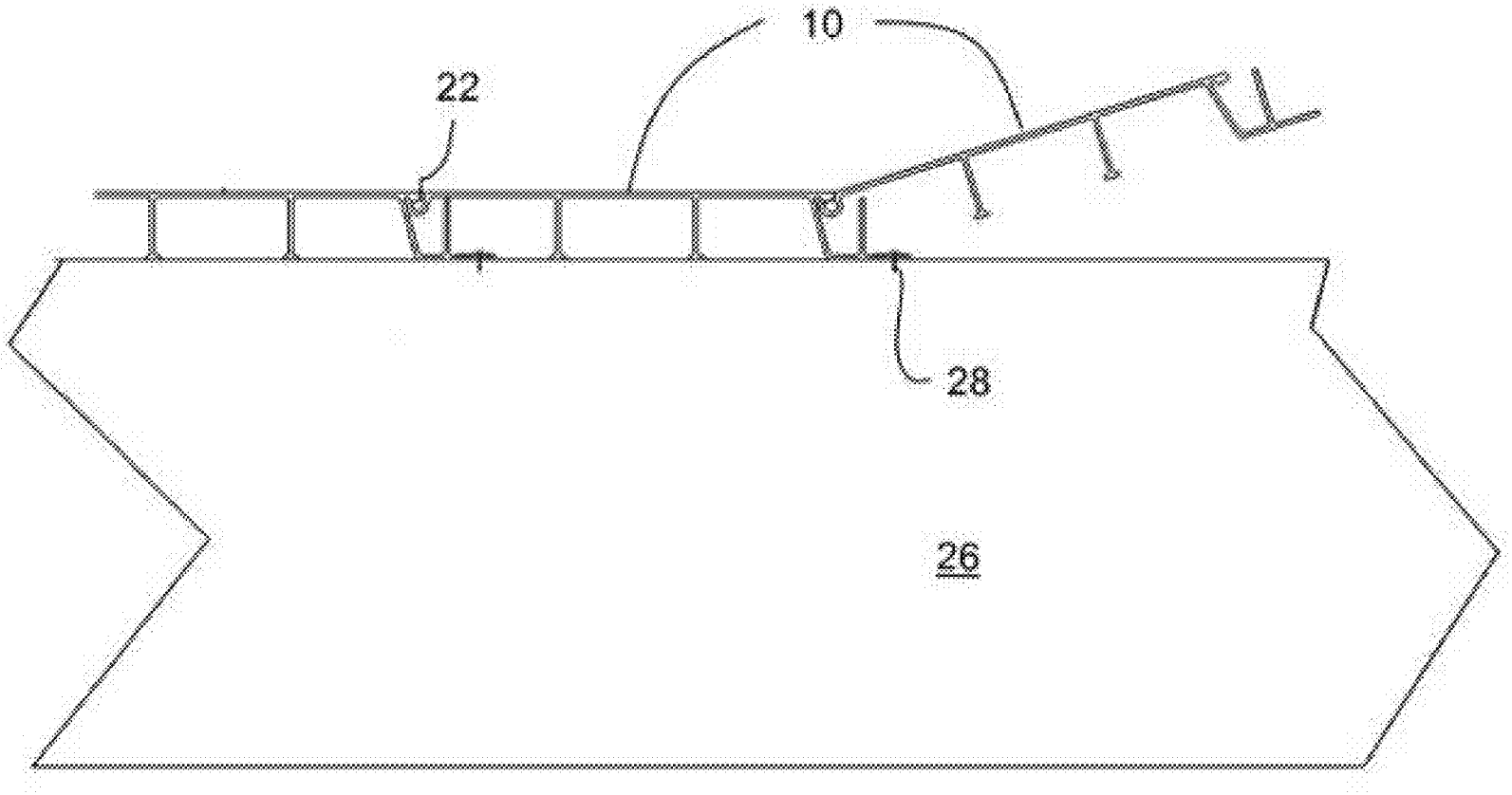
FIG. 5 Side elevation of planks during a deck assembly.
Figure 6A:
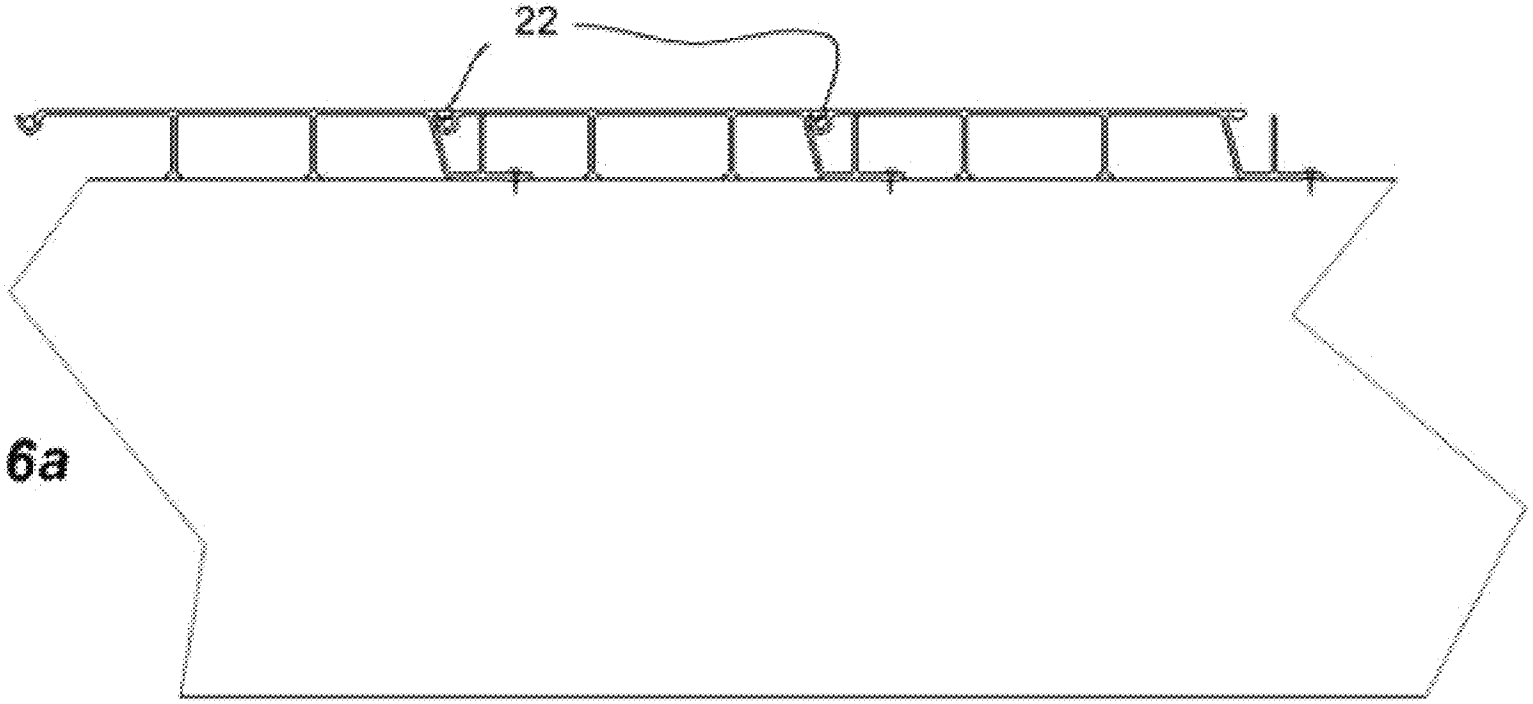
FIGS. 6*a-b* Side elevation of planks and close up of seal, after installation on a deck.
Figure 6B:
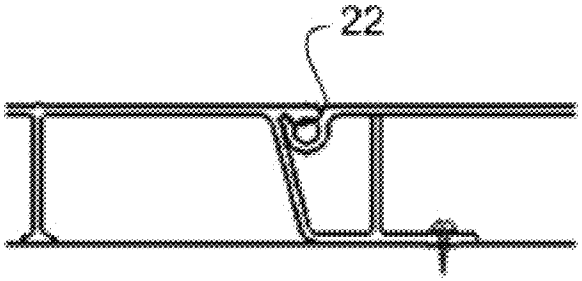

An aluminum deck plank (10) for use in building a deck (12) has an insertion member (14) further comprised of a sealing gasket (16) inserted into a groove (18) running the entire length of the plank (10). Upon insertion of the next plank (10) into the previous plank (10), the sealing gasket (16) is compressed against a gasket compression tab (20) so as to create a water barrier (22). Each plank (10) is mechanically fastened onto joists (26), forming the sub structure of the deck (12), by way of mechanical fasteners (28). The chosen mechanical fasteners (28) are of the type that can pierce through aluminum and continue on into the joists (26).

The plank (10) includes a fulcrum member (24) so named because it acts as a fulcrum for the next plank (10) as it is lowered into position and applies a compressive force into the previous plank (10), more specifically against the gasket compression tab (20) so that the gasket (16) is adequately compressed and able to act as the water barrier (22).

In order to add structural integrity to the planks (10), reinforcement ribs (30) are evenly spaced apart on the underside of the plank's (10) surface. An end rib (32) is located at the opposite side of the insertion member (14) and acts as a structural support just like the reinforcement ribs (30), as well as having a planar surface (34) from which perpendicularly extends the fulcrum member (24) and through which pass mechanical fasteners (28).

As to a further discussion of the manner of usage and operation of the present invention, the same should be apparent from the above description. For example, the aluminum planks (10) preferably have anti slip features either from patterns in the aluminum itself, or from a coating applied onto the aluminum, such as anti slip paint for example. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A deck plank for use in building a deck, said deck plank having an elongated length, two opposite sides extending along said elongated length, two ends located on opposite ends of said elongated length, and a continuous cross-section along said elongated length, said deck plank comprising an insertion member extending the length of one of said two sides and forming a groove extending the length thereof, said groove comprising opposing ribs shaped to retain a sealing gasket therein, said ribs separated by a space and defining an indentation above said groove, in said insertion member for receiving a gasket compression tab; the second of said two sides includes said gasket compression tab extending the length of said second side and having a substantially flat underside and shaped and adapted to engage in an indentation of a substantially identical adjacent deck plank, wherein said substantially flat underside is adapted to rest on a sealing gasket above a groove of said adjacent deck plank when engaged, and to compress the sealing gasket in said groove of said adjacent deck plank to thereby form a water barrier between said deck plank and said adjacent deck plank; said second of said two sides further includes an end rib, a planar surface, and a fulcrum member each extending the length thereof, wherein said fulcrum member is adapted to engage a surface of said adjacent deck plank when said insertion member of said adjacent deck plank engages said gasket compression tab of said deck plank, thereby adapted to create a compressive force between said insertion member of said adjacent deck plank when engaging said gasket compression tab of said deck plank, said end rib extending from said plank with a slant for providing a contact surface with an end rib contacting part of said insertion member when said compression tab is engaged and wherein said end rib contacting part is angled to match said slant of said end rib.

2. The deck plank of claim 1, wherein said insertion member and said sealing gasket both have circular cross-section.

3. The deck plank of claim 1, wherein said deck plank further includes at least one reinforcement rib extending along said elongated length thereof and having a width such that when said deck plank is in use within a structure of a deck, said at least one reinforcement rib, said end rib, and said planar surface are adapted to hold said deck plank in a parallel position to said deck structure.

4. The deck plank of claim 1, wherein said fulcrum member is formed perpendicular to said planar surface.

5. The deck plank of claim 1, wherein said deck plank is formed from a material or combination of materials chosen from a list of materials consisting of aluminum, plastic, and rubber.

6. The deck plank of claim 1, further comprising at least one mechanical fastener at each opposite end thereof and are adapted to secure said deck plank to joists of a deck structure.

7. The deck plank of claim 1, wherein said gasket compression tab includes a bulbous end adapted and shaped to engage said sealing gasket of an adjacent deck plank.

8. A deck for use along a housing structure, said deck comprising a plurality of parallel joist members, and opposite end joist members of connecting respective ends of said parallel joist members forming a deck shape; and a plurality of deck planks, each said deck plank having an elongated length equal to the length of said end joist members, two opposite sides extending along said elongated length, two ends located on opposite ends of said elongated length, and a continuous cross-section along said elongated length, said deck plank comprising an insertion member extending the length of one of said two sides and forming a groove extending the length thereof, said groove comprising opposing ribs shaped to retain a sealing gasket therein, said ribs separated by a space and defining an indentation above said groove, in said insertion member for receiving a gasket compression tab; the second of said two sides includes said gasket compression tab extending the length of said second side and having a substantially flat underside and shaped and adapted to engage in an indentation of a substantially identical adjacent deck plank, wherein said substantially flat underside is adapted to rest on a sealing gasket above a groove of said adjacent deck plank when engaged, and to compress the sealing gasket in said groove of said adjacent deck plank to thereby form a water barrier between said deck plank and said adjacent deck plank; said second of said two sides further includes an end rib, a planar surface, and a fulcrum member each extending the length thereof, wherein said fulcrum member is adapted to engage a surface of said adjacent deck plank when said insertion member of said adjacent deck plank engages said gasket compression tab of said deck plank, thereby adapted to create a compressive force between said insertion member of said adjacent deck plank when engaging said gasket compression tab of said deck plank, said end rib extending from said plank with a slant for providing a contact surface with an end rib contacting part of said insertion member when said compression tab is engaged and wherein said end rib contacting part is angled to match said slant of said end rib; wherein successive deck planks are fastened to said forming a deck surface, and thereby forming a water-tight deck.

9. The deck plank of claim 8, wherein each said insertion member and sealing gasket have circular cross-sections.

10. The deck plank of claim 8, wherein each said deck plank further includes at least one reinforcement rib extending along said elongated length thereof and having a width such that said at least one reinforcement rib, said end rib, and said planar surface are adapted to hold each said deck plank in a parallel position to said joists of said rectangular deck shape.

11. The deck plank of claim 8, wherein each said fulcrum member is formed perpendicular to its respective planar surface.

12. The deck plank of claim 8, wherein each said deck plank is formed from a material or combination of materials chosen from a list of materials consisting of aluminum, plastic, and rubber.

13. The deck plank of claim 8, further comprising at least one mechanical fastener at each opposite end of each said deck plank, and are adapted to secure each said deck plank to respective joists of a deck structure.

14. The deck plank of claim 8, wherein each said gasket compression tab includes a bulbous end adapted and shaped to engage each respective said sealing gasket of an adjacent deck plank.

* * * * *